US005324154A

United States Patent [19]

Jones et al.

[11] Patent Number: 5,324,154

[45] Date of Patent: Jun. 28, 1994

[54] BINDING PERFORATED SHEETS

[75] Inventors: Leonard W. N. Jones, Hindhead; Paul Metcalfe, Kingston-Upon-Thames, both of Great Britain

[73] Assignee: James Burn International Limited, Great Britain

[21] Appl. No.: 927,980

[22] Filed: Aug. 11, 1992

[30] Foreign Application Priority Data

Aug. 19, 1991 [GB] United Kingdom ..... 9117878

[51] Int. Cl.[5] ..... B42B 5/10

[52] U.S. Cl. ..... 412/39

[58] Field of Search ..... 412/7, 33, 38, 39; 140/71 R

[56] References Cited

U.S. PATENT DOCUMENTS 4,482,279 11/1984 Jones et al. ..... 412/39
4,934,890 6/1990 Flatt ..... 412/39
5,059,078 10/1991 Schmid ..... 412/39

FOREIGN PATENT DOCUMENTS 438748 7/1991 European Pat. Off. .
529881 3/1993 European Pat. Off. ..... 412/39

*Primary Examiner*—Mark Rosenbaum
*Assistant Examiner*—S. Thomas Hughes
*Attorney, Agent, or Firm*—Wood, Herron & Evans

[57] ABSTRACT

A jaw for use in a machine for closing a wire binding element (8) comprises a longitudinal member (30) having a curved cylindrical working surface (32) and a grooved strip (36) located in a slot (34) formed in the working surface (32) so that the grooved edge of the strip (36) projects inwardly from the working surface (36), the space between adjacent grooves being equal to the pitch of the wire binding element (8).

7 Claims, 3 Drawing Sheets

BINDING PERFORATED SHEETS

This invention relates to machines for binding numbers of perforated sheets with wire binding elements to form for example books and calendars.

One type of wire binding element is formed from a length of metal wire bent to form a series of curved hairpin shaped prongs on which the sheets are impaled and which are brought to ring shape by bringing their closed end or "points" into the vicinity of their open ends or "roots". When it is in the condition in which the impaling of the sheets on its prongs is effected, the wire binding element is in the form of a tube having a slot in its wall extending over its whole length. Such a wire binding element in such condition will be referred to herein as a "wire binding element of the type described".

One type of machine for closing wire binding elements of the type described is described in British Patent Specification No. 1209939. In such a machine a wire binding element of the type described is closed to bind a book by a pair of jaws, the working faces of which are segments of a cylinder of substantially the same diameter as the prongs when the latter are brought to ring shape. The closure of the prongs is achieved by the rotation of the jaws about their longitudinal axes at the same time as the jaws are forced towards each other so as to form a single segment of a cylinder and bringing a wire binding element of the type described positioned therebetween to ring shape. Such a machine will be referred to herein as a "machine of the type described".

One disadvantage in machines of the type described is that they provide no positive means of aligning a wire binding element of the type described longitudinally with respect to the perforated edge of the sheets. For the binding operation to be carried out cleanly and effectively, it is essential that the closed ends or "points" of the wire binding element of the type described are brought into alignment with the perforations in the sheet to be bound. This alignment is usually carried out by providing holes in the working surface of the jaws, the holes being separated by a distance equal to the pitch of the wire binding element of the type described, into which pins are inserted. In use, the pins locate the wire binding element longitudinally with respect to the working surface of the jaws. Such jaws are relatively expensive to manufacture, requiring a number of precise machining operations and a large number of parts.

A jaw for use in a machine of the type described in accordance with the invention comprises a longitudinal member having a curved cylindrical working surface and a grooved strip so located that its grooved edge projects inwardly of the working surface, the space between adjacent grooves being equal to the pitch of the wire binding element. The sides or "shoulders" of each groove then engage the outside of each prong of a wire binding element of the type described and thus align the prongs longitudinally with respect to the working surface of the jaws.

The grooved strip may be formed with an upstanding lug between the shoulders of each groove to grip the inside of each narrow prong of a wire binding element of the type described.

A jaw in accordance with the invention enables a wire binding element to be very accurately located, as each side of each curve of the wire is retained between one shoulder of a groove in the strip and the lug.

Conveniently the longitudinal member may be formed as a longitudinal extrusion. The formation of such a member by extrusion is a less expensive method of manufacture than machining from a solid blank.

Appropriately the longitudinal member may be made of aluminium or an alloy thereof. A longitudinal member made of such a material is relatively cheap and simple to extrude. It is also considerably lighter and relatively cheaper than an equivalent steel member. A machine incorporating such a member may therefore be made more cheaply and less rigidly because the reciprocating mass of the jaws is reduced by using such a material.

Preferably the working surface of a jaw wherein the longitudinal member is made of aluminium is treated to improve its wear resistance. Such treatment may be by, for example, hard anodising, an operation well-known in the art. Preferably the grooved strip is made of plastic, rubber or a rubber-like material. The manufacture of such a grooved strip is considerably cheaper and simpler than the manufacture and incorporation of a number of pins as in conventional jaws.

Appropriately, the grooved strip may be held in a slot formed in the working surface of the jaw by a suitable adhesive. Such a slot may be readily formed during the extrusion of the longitudinal member. Additionally, the replacement of a grooved strip necessitated by wear or damage during use may be quickly and cheaply carried out. It will be apparent that the use of such jaws in machines of the type described enables such machines to be made less expensively than heretofore. Where machines of the type described are adapted to use interchangeable pairs of jaws where each pair of jaws is configured and dimensioned so as to accommodate wire binding elements having a particular diameter, the use of jaws as described above enables a considerable reduction in expense.

An embodiment of a jaw in accordance with the invention will now be described by way of example with reference to the following drawings, in which.

Figure 1:
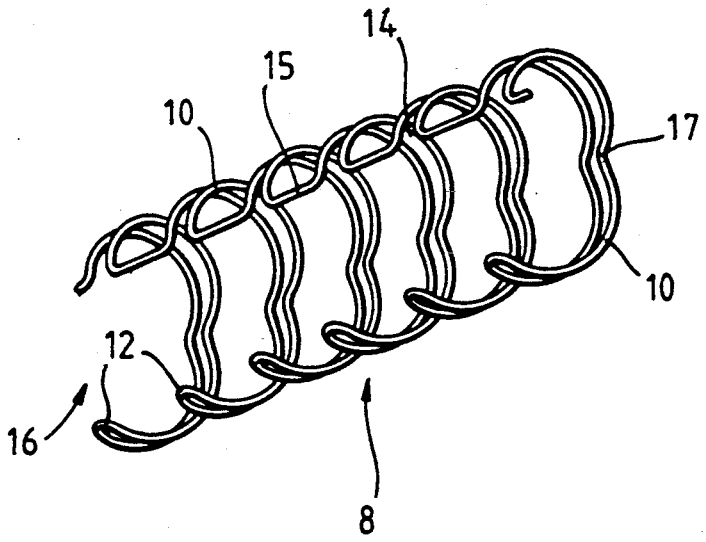
FIG. 1 is a perspective view of a section of a wire binding element of the type described.

FIG. 1 shows a section generally indicated at 8 of a wire binding element of the type described comprising a series of curved hairpin shaped prongs 10 having closed ends or "points" 12 and open ends or "roots" 14, the prongs at their roots being connected to their neighbours by straight portions 15. The section of wire binding element 8 is in the form of a tube having in its wall a longitudinal slot 16 extending over its whole length.

The binding operation comprises impaling the perforated sheets on the curved prongs and bringing the points of the prongs into the vicinity of their roots. The latter operation is assisted by the kink 17 in the prongs but the prongs may be C-shaped i.e. the kink is not essential.

Figure 2:
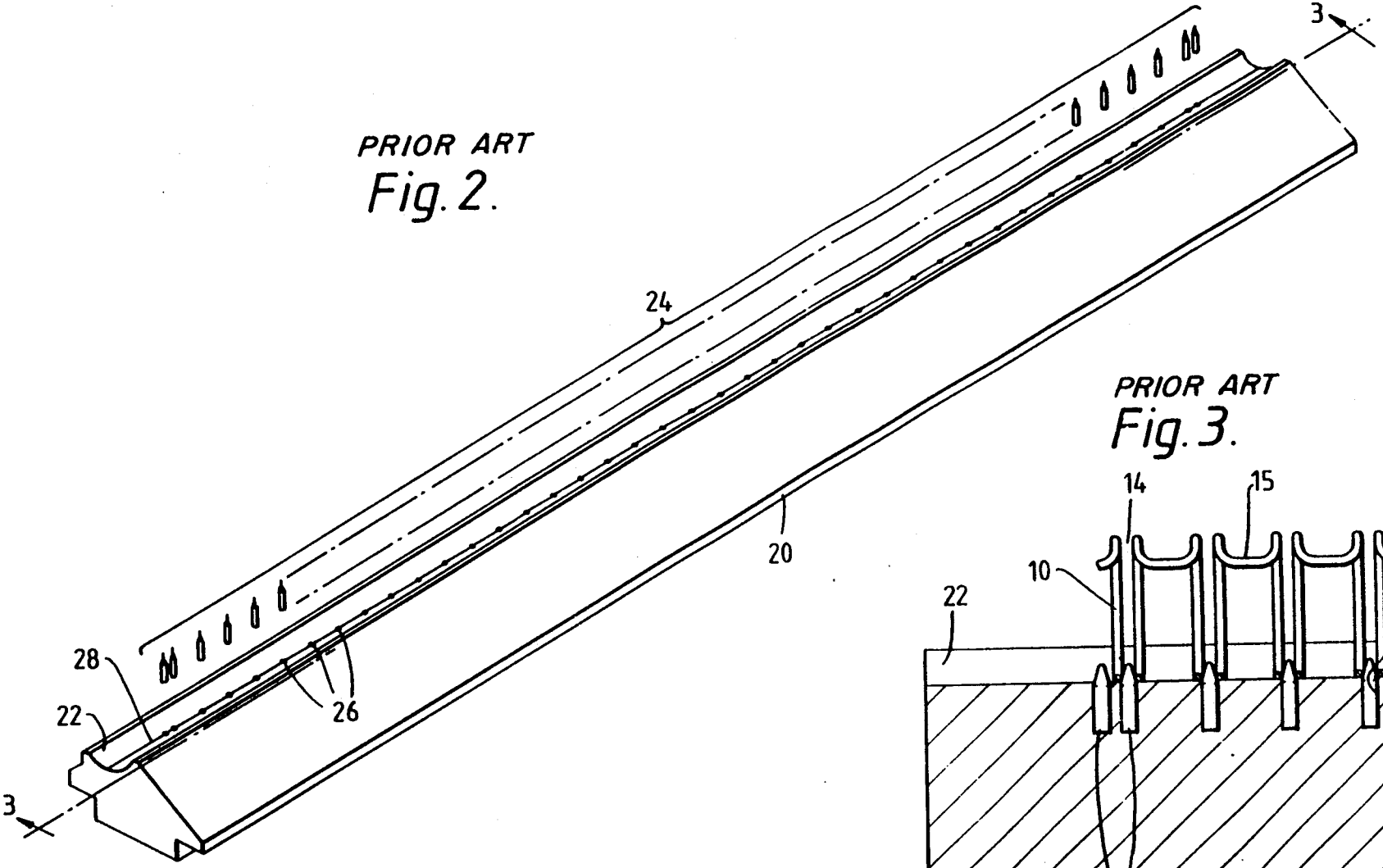
PRIOR ART Fig. 2.
FIG. 2 is a perspective exploded view of a conventional jaw for use in a machine of the type described.
Figure 3:
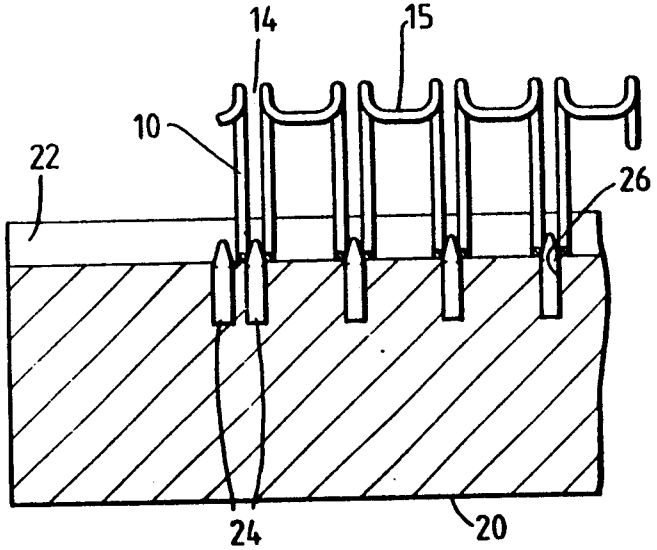
PRIOR ART Fig. 3.
FIG. 3 is a part cross-sectional view along the line 3—3 of FIG. 2, showing the location of a wire binding element of the type described.

Referring now to FIG. 2, a conventional jaw of a machine of the type described, is shown comprising a longitudinal member 20 having a curved, part-cylindrical working surface 22. A plurality of pins 24 are seated within a corresponding number of holes 26 (as shown in FIG. 3) disposed along a line 28 parallel to the axis of the member 20 and spaced apart by a distance equal to the pitch of the wire binding element. When such a wire binding element 8 is located adjacent the working surface 22 the pins fit between the curved prongs 10 so as to align the wire binding element with respect to the axis of the member 20, as shown in FIG. 3.

Figure 4:
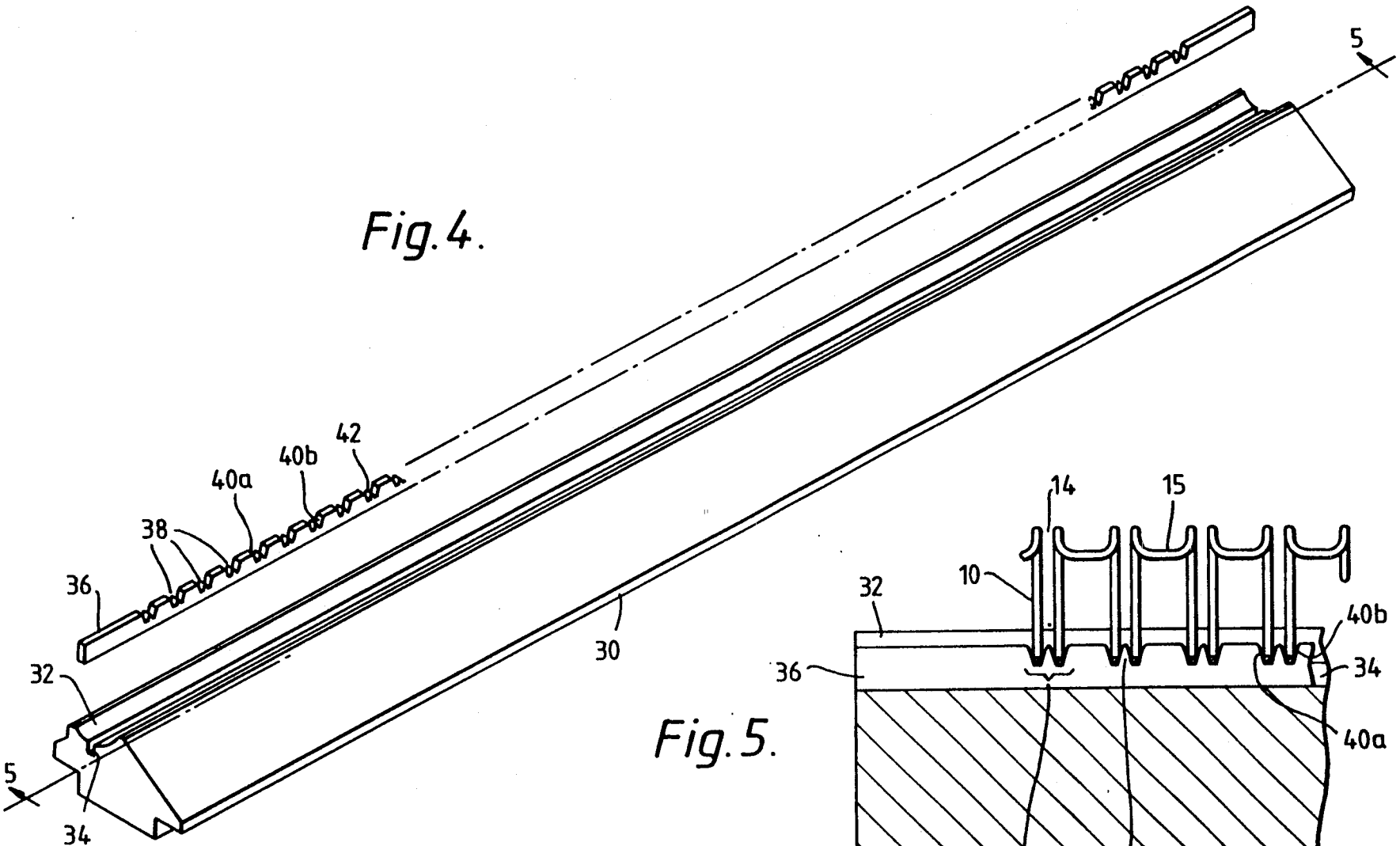
FIG. 4 is a perspective exploded view of a jaw in accordance with the invention.

A jaw in accordance with the invention is shown in FIG. 4 and is for use in a machine of the type described. The jaw comprises a longitudinal member 30 having a curved cylindrical working surface 32 in which is formed a slot 34. A grooved strip 36 extends substantially the length of longitudinal member 30 and is dimensioned to fit within slot 34 with its grooved edge projecting into the area partially enclosed by curved cylindrical working surface 32.

Figure 5:
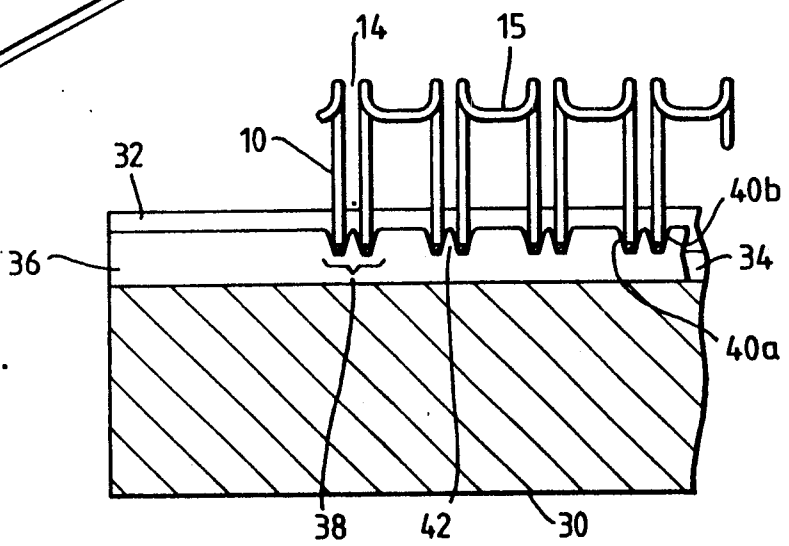
FIG. 5 is a part cross-sectional view along the line 5—5 of FIG. 4 showing the location of a wire binding element of the type described.

The grooved strip 36 is formed with a plurality of grooves 38 along one edge, each groove being spaced from its neighbour by a distance equal to the pitch of the prongs of the wire binding element. Each groove has shoulders 40*a* and 40*b*, and between these shoulders is formed an upstanding lug 42. When a wire binding element is located adjacent the working surface 32 the curved prongs 10 fit between shoulders 40*a* and 40*b* and the opposite faces of lug 42, as shown in FIG. 5.

During rotation of the longitudinal member 32 about its axis and/or movement of longitudinal member 32 perpendicular to its axis, the wire binding element is firmly retained along the axis of the member 32 by the grooved strip 36.

The grooved strip 36 is formed with a plurality of grooves 38 along one edge, each groove being spaced from its neighbour by a distance equal to the pitch of the prongs of the wire binding element. Each groove has shoulders 40*a* and 40*b*, and between these shoulders is formed an upstanding lug 42. When a wire binding element is located adjacent the working surface 32 the curved prongs 10 fit between shoulders 40*a* and 40*b* and the opposite faces of lug 42, as shown in FIG. 5.

During rotation of the longitudinal member 32 about its axis and/or movement of longitudinal member 32 perpendicular to its axis, the wire binding element is firmly retained along the axis of the member 32 by the grooved strip 36.

We claim:

1. A machine for binding perforated sheets with a wire binding element of the kind having a series of curved prongs which define plural points and plural roots, said prongs being spaced a distance one from the other, said sheets each having plural perforations, and said sheets being bound upon closing said prongs through said sheets' perforations by closing said points adjacent to said roots, said machine comprising a closing jaw adapted to cooperate with said element for closing said element's prongs, said jaw defining an arcuate working surface that contacts said element's prongs as said prongs are closed, and a grooved strip fixed to said jaw's working surface, said grooved strip having a grooved edge located inwardly of said jaw's working surface to cooperate with said element's prongs, said grooved edge defining a series of grooves along its length spaced one from the other a distance equal to said distance of said element's prongs one from the other, each of said grooves being adapted to receive one of said element's prongs in order to aid in maintaining alignment of said prongs relative to said sheets' perforations as said jaw closes said prongs.

2. A machine as set forth in claim 1, each of said prongs comprising two wires, and each of said grooves comprising opposed shoulders against which a prong's wires can be seated when said prong is located within said prong's associated groove, and an upstanding lug located between said groove's shoulders to keep separate said two wires of a prong seated within said prong's associated groove.

3. A machine as set forth in claim 1, said machine comprising structure defining a slot in said jaw's arcuate surface, said grooved strip being seated in said slot to fix said grooved strip to said jaw's working surface.

4. A machine as set forth in claim 3, said grooved strip being fabricated from at least one of a plastic material and a rubber material.

5. A machine as set forth in claim 1, said jaw being formed from a longitudinal extrusion.

6. A machine as set forth in claim 5, said jaw being made from one of aluminum and an alloy thereof.

7. A machine as set forth in claim 6, said jaw's working surface being treated to improve its wear resistance.

* * * * *